US008655208B2

(12) United States Patent
Hibi et al.

(10) Patent No.: US 8,655,208 B2
(45) Date of Patent: Feb. 18, 2014

(54) IMAGE FORMING APPARATUS FOR IMAGE TRANSFER ONTO A TRANSFER MEMBER

(75) Inventors: Yoshitaka Hibi, Mishima (JP); Hironobu Nihei, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 13/210,226

(22) Filed: Aug. 15, 2011

(65) Prior Publication Data

US 2012/0045233 A1 Feb. 23, 2012

(30) Foreign Application Priority Data

Aug. 20, 2010 (JP) ..... 2010-185087

(51) Int. Cl.
*G03G 15/00* (2006.01)

(52) U.S. Cl.
USPC ..... 399/49

(58) Field of Classification Search
USPC ..... 399/49, 66, 68
See application file for complete search history.

(56) References Cited

U.S. PATENT DOCUMENTS

| | | | | |
|---|---|---|---|---|
| 5,974,282 | A * | 10/1999 | Yamada | 399/66 |
| 6,445,900 | B2 * | 9/2002 | Fukao et al. | 399/302 |
| 2001/0022907 | A1 | 9/2001 | Fukao et al. | |
| 2007/0071475 | A1 * | 3/2007 | Blair et al. | 399/68 |

FOREIGN PATENT DOCUMENTS

| | | | |
|---|---|---|---|
| CN | 101030063 | A | 9/2007 |
| CN | 101651768 | A | 2/2010 |
| CN | 101718960 | A | 6/2010 |
| EP | 2028553 | A1 | 2/2009 |
| JP | 09-123553 | A | 5/1997 |
| JP | 2001-201994 | A | 7/2001 |
| JP | 2002-174957 | A | 6/2002 |
| JP | 2005-250492 | A | 9/2005 |

* cited by examiner

*Primary Examiner* — Quana M Grainger
(74) *Attorney, Agent, or Firm* — Canon USA Inc. IP Division

(57) ABSTRACT

An image forming apparatus performs control so that a wrinkle is formed at a predetermined position of an intermediate transfer belt and, when forming a toner image having such a large size that the toner image overlaps the wrinkle formed in the intermediate transfer belt, the leading edge and the trailing edge of the toner image overlap the wrinkle.

15 Claims, 17 Drawing Sheets

IMAGE FORMING APPARATUS FOR IMAGE TRANSFER ONTO A TRANSFER MEMBER

BACKGROUND OF THE INVENTION

1. Field of the Invention

The present invention relates to an image forming apparatus, such as an electrophotographic copier, printer, or facsimile, and, in particular, to an image forming apparatus including an intermediate transfer member onto which an image is transferred.

2. Description of the Related Art

Some existing image forming apparatuses include an intermediate transfer belt serving as an intermediate transfer member onto which a toner image formed on a photosensitive drum is transferred. In such image forming apparatuses, in order to control driving of an intermediate transfer belt, a reference mark formed of a light reflecting member is provided on the intermediate transfer belt. In addition, a detection sensor for optically detecting the reference mark is provided.

In order to form an image, such an image forming apparatus performs control so as to start an image forming process after a preset period of time has elapsed since the reference mark was detected by a detection sensor and transfer a toner image onto an intermediate transfer belt at a predetermined position. In addition, when the image forming process is completed, the image forming apparatus performs control so as to stop the intermediate transfer belt after a preset period of time has elapsed since the reference mark was detected by a detection sensor. Thus, the intermediate transfer belt stops at the same position. This is to make a first printout time (hereinafter also referred to as an "FPOT") constant.

Since the intermediate transfer belt is held tight around a plurality of support rollers, partial wrinkle of the intermediate transfer belt may occur at a position at which the intermediate transfer belt is in contact with the support roller if, as described above, the intermediate transfer belt stops at the same position. If a wrinkle occurs, a toner image transferred onto the intermediate transfer member cannot be transferred onto a recording material at an accurate position. Accordingly, an image defect, such as white streaking, may occur. To address such an issue, Japanese Patent Laid-Open No. 2001-201994 describes a technique for reducing the probability of the occurrence of such an image defect caused by a wrinkle of an intermediate transfer belt by performing control so that the intermediate transfer belt stops at least two different positions.

If, as described in Japanese Patent Laid-Open No. 2001-201994, the intermediate transfer belt is stopped at least two different positions, the occurrence of an image defect caused by a wrinkle can be reduced. However, if a difference between the length of the intermediate transfer member and the length of a transferred toner image is small, the toner image is forced to be transferred onto a wrinkle of the intermediate transfer member and, therefore, an image defect occurs in the toner image transferred onto the wrinkle.

SUMMARY OF THE INVENTION

The present invention provides an image forming apparatus capable of performing control so that a negative impact of a wrinkle on a toner image is minimized and, therefore, the probability of the occurrence of an image defect caused by the wrinkle is reduced even when the toner image is transferred onto a wrinkle formed in an intermediate transfer belt.

According to an aspect of the present invention, an image forming apparatus includes an image bearing member, a developing unit configured to develop a latent image formed on the image bearing member into a toner image, an intermediate transfer member, a transfer unit configured to transfer the toner image formed on the image bearing member onto the intermediate transfer member, a tension member configured to support the intermediate transfer member, and a control unit configured to control a point in time at which the transfer unit transfers the toner image so that the leading edge and trailing edge of the toner image overlap an imprint portion formed in the intermediate transfer member by the tension member.

Further features of the present invention will become apparent from the following description of exemplary embodiments with reference to the attached drawings.

DESCRIPTION OF THE EMBODIMENTS

First Embodiment

Embodiments of the present invention are described below with reference to the accompanying drawings. Note that the following embodiments should not be construed as restricting the sprit or scope of the invention described in the attached claims in any way, and not all combinations of features described in the embodiments of the present invention are indispensable for solving means of the present invention.

Image Forming Operation Performed by Image Forming Apparatus

Figure 1:
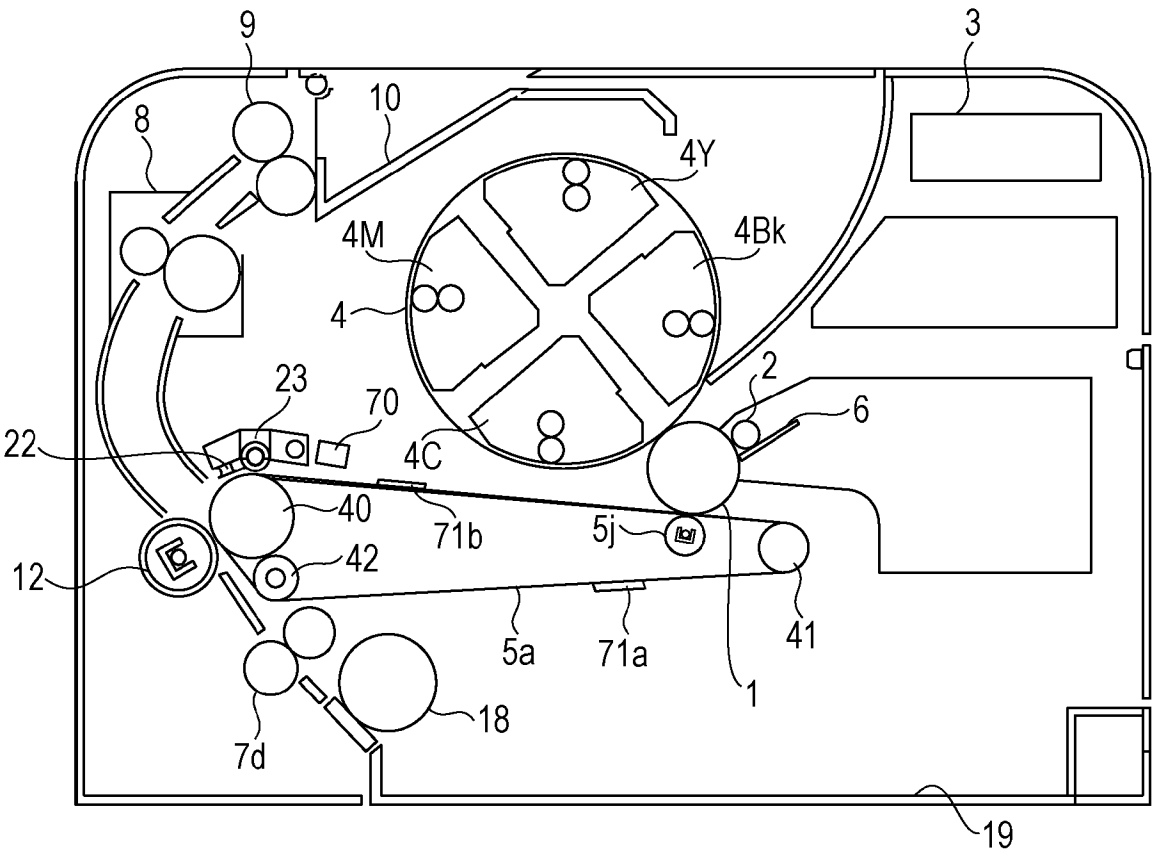
FIG. 1 is a schematic illustration of the configuration of an image forming apparatus.

FIG. 1 is a schematic illustration of an exemplary configuration of a laser printer, which is an example of an image forming apparatus. The image forming operation performed by the image forming apparatus is described below. An intermediate transfer belt 5*a* serving as the intermediate transfer member is held tight around a driving roller 40, a first driven roller (a tension roller) 41, and a second driven roller (an idler roller) 42 serving as a tension member. The intermediate transfer belt 5*a* is rotated in synchronization with the rotation of a photosensitive drum 1 serving as an image bearing member. The surface of the photosensitive drum 1 is uniformly charged by a charging unit 2. Exposure for a yellow (Y) image is performed by an exposure unit 3 so that a Y electrostatic latent image is formed on the photosensitive drum 1 (the image bearing member). At the same time as the electrostatic latent image is formed, a rotary developing apparatus 4 is driven, and a Y developing unit 4Y is moved to a development position. Driving force is transferred to the Y developing unit 4Y moved to the development position by a development coupling (not shown). Thus, the Y developing unit 4Y is rotated. The Y developing unit 4Y applies, to Y toner, a voltage having a polarity that is the same as the polarity of charge on the photosensitive drum 1 and a level that is substantially the same as that of the charge on the photosensitive drum 1. Thus, Y toner serving as a developer is deposited to the electrostatic latent image, and the toner image is developed. Thereafter, a voltage having a polarity that is opposite to the polarity of the toner image is applied to a primary transfer roller 5*j* disposed inside the intermediate transfer belt 5*a*. Thus, the toner image on the photosensitive drum 1 is primarily transferred onto the intermediate transfer belt 5*a* (an intermediate transfer member).

After primary transfer of the Y toner image is completed, the rotary developing apparatus 4 is driven so that a developing unit for the next color is moved to the development position. As in the case for Y, toner images for magenta (M), cyan (C), and black (Bk) are sequentially formed, and the toner images of the four colors are overlaid on one another on the intermediate transfer belt 5*a*. Note that the position of the rotary developing apparatus 4 is detected by a rotary position detection sensor and is controlled. In addition, while primary transfer of each of the colors is being performed, a secondary transfer roller 12 is located at a position at which the secondary transfer roller 12 is not in contact with the intermediate transfer belt 5*a*. Similarly, a charging brush 22 and a charging roller 23 that serve as a cleaning unit are located at positions at which the charging brush 22 and the charging roller 23 are not in contact with the intermediate transfer belt 5*a*.

After the toner images of four colors are formed on the intermediate transfer belt 5*a*, the secondary transfer roller 12 is brought into contact with the intermediate transfer belt 5*a*. Thus, a secondary transfer unit is formed. In synchronization with timing at which an image formed on the intermediate transfer belt 5*a* is conveyed to the secondary transfer unit, a sheet is fed from a stacking unit 19 using a pickup roller 18. Thus, the recording material located at a predetermined standby position is conveyed to the secondary transfer unit by using a pair of conveying rollers 7*d* serving as a sheet re-feed unit. Since a voltage having a polarity opposite to that of the toner is applied to the secondary transfer roller 12, the toner images on the intermediate transfer belt 5*a* are secondarily transferred onto the surface of the recording material.

The recording material having the images secondarily transferred thereonto is conveyed to a fusing unit 8, which fuses the images. Thereafter, the recording material is output to a paper output tray 10 by a pair of eject rollers 9. In this way, image formation is completed.

Intermediate Transfer Belt Unit and Photosensitive Drum Unit

Figure 2:
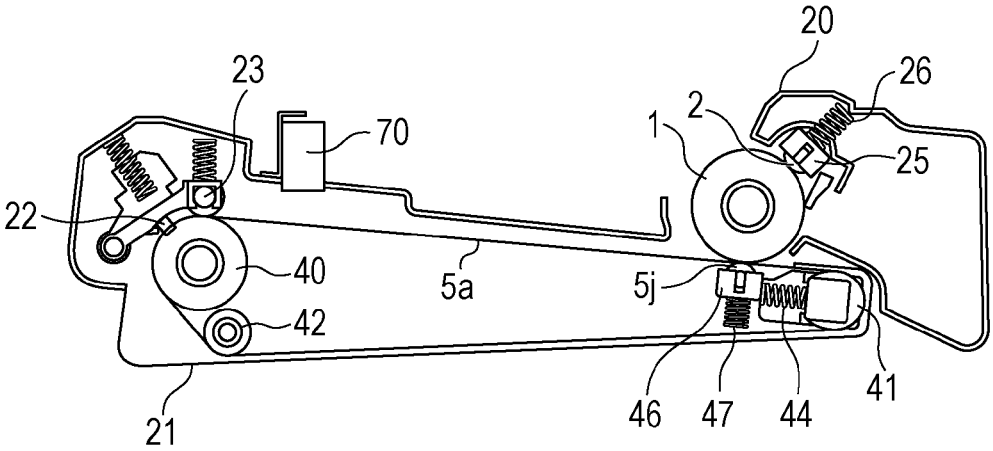
FIG. 2 is a cross-sectional view of an intermediate transfer belt unit and a photosensitive drum unit.
Figure 3:
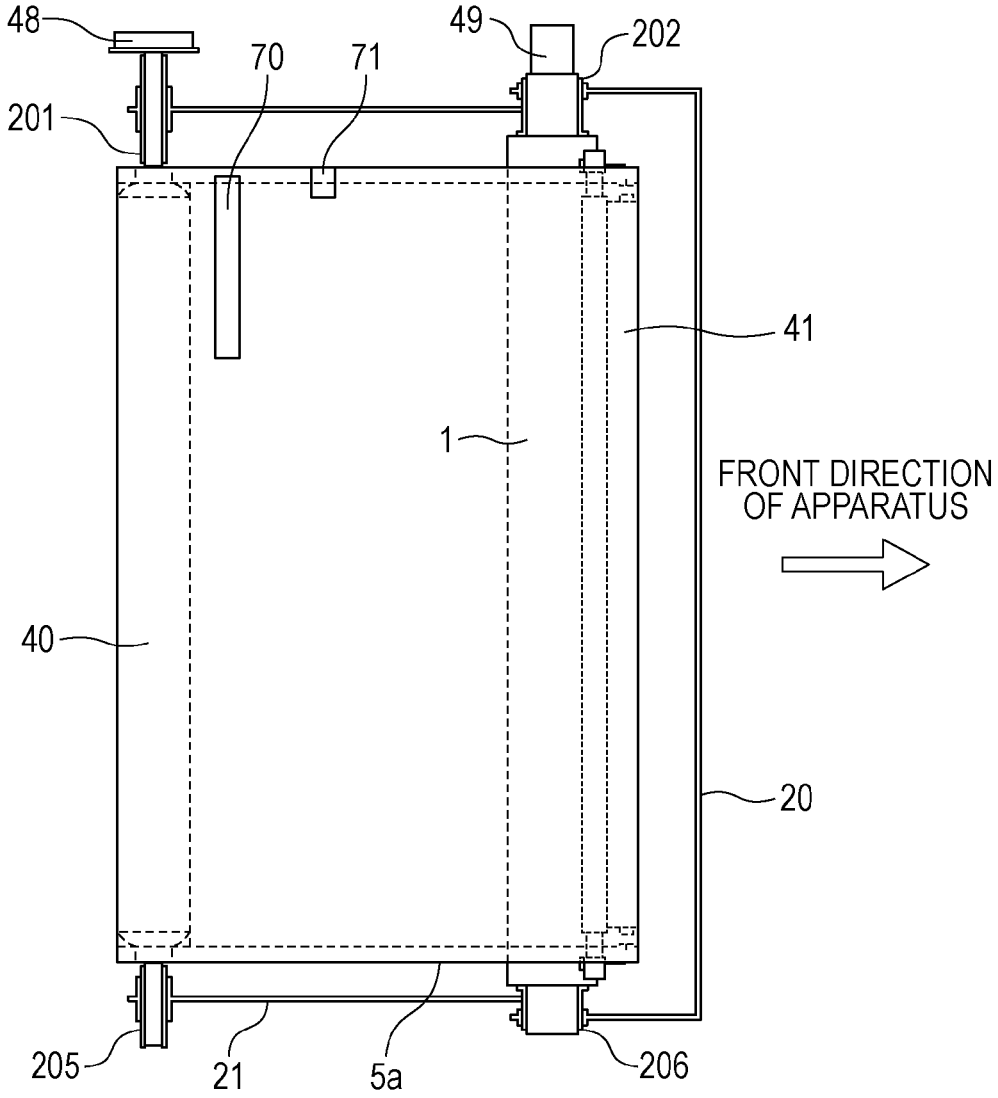
FIG. 3 is a transverse cross section of the intermediate transfer belt unit and the photosensitive drum unit.

FIG. 2 is a cross-sectional view of an intermediate transfer belt unit 21 and a photosensitive drum 20. FIG. 3 is a cross-sectional view of the intermediate transfer belt unit 21 and the photosensitive drum 20 when viewed from above. The intermediate transfer belt unit 21 and the photosensitive drum 20 are described below.

The photosensitive drum 20 is described first. Two ends of the photosensitive drum 1 are rotatably supported by a right bearing 202 and a left bearing 206. A predetermined rotational driving force is transferred from the image forming apparatus to the right end of the photosensitive drum 20 via a coupling 49. In addition, the charging unit 2 is in contact with the photosensitive drum 1 with a predetermined pressure via bearings 25 at either end of the charging unit 2 using a compression spring 26. Thus, the charging unit 2 is rotated upon rotation of the photosensitive drum 1.

The intermediate transfer belt unit 21 is described next. The intermediate transfer belt 5*a* is held in tension around the driving roller 40, the first driven roller (tension roller) 41, and the second driven roller (idler roller) 42. Note that according to the present embodiment, the length of the intermediate transfer belt 5*a* is greater than a maximum length of an image formable by the image forming apparatus in the length direction and is less than double the maximum length of the image formable by the image forming apparatus in the length direction. The ends of the driving roller 40 are rotatably supported by a right bearing 201 and a left bearing 205. A predetermined rotational driving force is transferred from the image forming apparatus to the driving roller 40 via a drive gear 48 disposed in a right bearing unit. The bearings at both ends of the first driven roller 41 have a compression spring 44. Thus, predetermined tension is applied to the intermediate transfer belt 5*a*. The primary transfer roller 5*j* is located on the opposite side of the intermediate transfer belt 5*a* from the photosensitive drum 1. The primary transfer roller 5*j* is in pressure contact with the intermediate transfer belt 5*a* with a compression spring 47 via bearings 46 provided on both ends of the primary transfer roller 5*j*. Thus, the primary transfer roller 5*j* is rotated upon rotation of the intermediate transfer belt 5*a*. At least one of the bearings is formed from a conductive member. By applying a predetermined bias to the primary transfer roller 5*j*, toner on the photosensitive drum 1 can be primarily transferred onto the intermediate transfer belt 5*a*.

In order to detect the position of the intermediate transfer belt 5*a* in the conveying direction and control registration of toner images of individual colors that are overlaid on the intermediate transfer belt 5*a*, an optical detection sensor (photosensor) 70 and a reference mark 71 that serve as a position detecting unit are provided for the intermediate transfer belt 5*a*. The reference mark 71 is placed outside the area in which an image is formed in the width direction of the intermediate transfer belt 5*a*. The reflective optical detection sensor 70 is disposed at a predetermined position so as to face the reference mark 71. By detecting light reflected by the reference mark 71, the image forming apparatus controls the position of the intermediate transfer belt 5*a* in the conveying direction, the position at which an image is written, and the timing at which image data is written onto the photosensitive drum 1 by an exposure unit 3.

Figure 4:
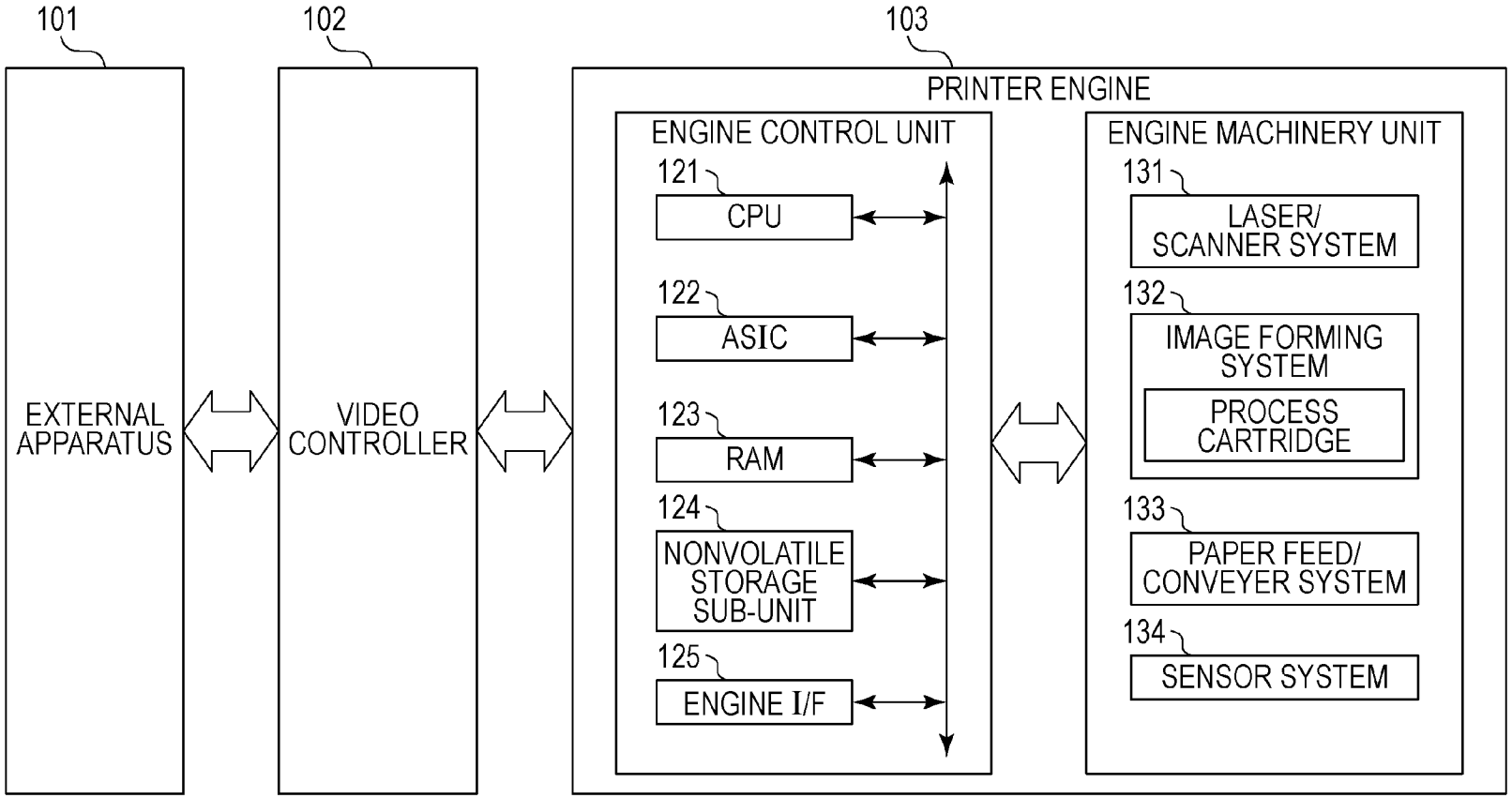
FIG. 4 is a hardware block diagram illustrating the system configuration of the image forming apparatus.

FIG. 4 is a block diagram of the hardware illustrating the system configuration of the image forming apparatus. An external apparatus 101, a video controller 102, and a printer engine 103 are shown in FIG. 4. The printer engine 103 is described in detail below. The printer engine 103 includes an engine control unit and an engine machinery unit. The engine machinery unit operates under the control of the engine control unit. The engine machinery unit is described in detail first, and, subsequently, the engine control unit is described in detail.

A laser/scanner system 131 includes a laser-emitting element, a laser driver circuit, a scanner motor, a rotatable polygon mirror, and a scanner driver. The laser/scanner system 131 forms a latent image on the photosensitive drum 1 by a laser beam scanning the photosensitive drum 1 for exposure in accordance with image data transmitted from the video controller 102. An image forming system 132 plays a main role of the image forming apparatus. The image forming system 132 forms a toner image on a recording material on the basis of the latent image formed on the photosensitive drum. The image forming system 132 includes process elements, such as a process cartridge, the intermediate transfer belt 5*a*, and the fusing unit 8, and a high-voltage power supply circuit that generates a variety of biases (high voltages) required for forming an image. The process cartridge includes a discharging unit, an electrical charging roller, a developing roller, and a photosensitive drum. The process cartridge further includes a nonvolatile memory tag. A central processing unit (CPU) 121 or an application specific integrated circuit (ASIC) 122 reads and writes a variety of types of information from and to the memory tag.

A paper feed/conveyer system 133 controls feeding of a recording material and conveying of the recording material. The paper feed/conveyer system 133 includes a variety of conveyer motors, paper feed and output trays, and a variety of conveying rollers. A sensor system 134 is formed from a sensor group of sensors for collecting information required for control performed by the CPU 121 and the ASIC 122 (described in more detail below). The sensor group includes at least widely used sensors, such as a temperature sensor for the fusing unit 8, a toner level sensor, a color density sensor for detecting the color density of an image, a sheet size sensor, a sheet leading edge detecting sensor, and a sheet conveyance detecting sensor. Information detected by such sensors is acquired by the CPU 121 and is used for print sequence control. Note that in FIG. 4, the sensor system 134 is separated from the laser/scanner system 131, the image forming system 132, and the paper feed/conveyer system 133. However, the sensor system 134 may be integrated into one of the other systems.

The engine control unit is described next. The CPU 121 controls the engine machinery unit in accordance with a variety of control programs stored in a nonvolatile storage subunit 124 using a RAM 123 as a main memory and a work area. More specifically, the CPU 121 drives the laser/scanner system 131 on the basis of a print control command and image data input from the video controller 102 via an engine interface 125. In addition, the CPU 121 controls a variety of print sequences by controlling the image forming system 132 and the paper feed/conveyer system 133. Furthermore, the CPU 121 acquires information required for controlling the image forming system 132 and the paper feed/conveyer system 133 by driving the sensor system 134. In contrast, under the control of the CPU 121, the ASIC 122 controls a variety of motors used for executing the above-described variety of print sequences and high voltages, such as a development bias. Note that some or all of the functions of the CPU 121 may be performed by the ASIC 122. Alternatively, some or all of the functions of the ASIC 122 may be performed by the CPU 121. Still alternatively, some of the functions of the CPU 121 and the ASIC 122 may be performed by newly provided dedicated hardware.

Figure 5A:
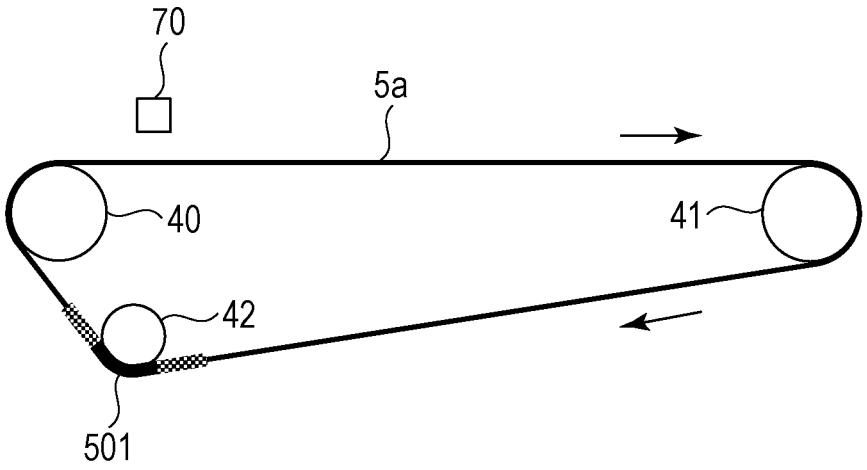
FIGS. 5A and 5B illustrate a wrinkle formed in an intermediate transfer belt, an area in which the wrinkle is formed, and an area in which a toner image is formed.

FIG. 5A illustrates a wrinkle occurring in the intermediate transfer belt 5*a* due to contact of the intermediate transfer belt 5*a* with the second driven roller 42. Note that the wrinkle is formed as an imprint portion. As used herein, the term "imprint portion" refers to a portion of the intermediate transfer belt 5*a* that is locally deformed by the second driven roller 42. If the intermediate transfer belt 5*a* stops at the same position, a wrinkle 501 due to the second driven roller (support roller) 42 occurs in a portion that is in contact with the support roller 42 over time. Note that it is difficult for the intermediate transfer belt 5*a* to stop at the same position and, thus, the stop position slightly varies. Therefore, in reality, the wrinkle 501 is a set of wrinkles occurring at a plurality of positions. Accordingly, the wrinkle 501 represents wrinkles occurring in a region after taking into account variation in the positions at which an intermediate transfer belt drive motor stops (the right and left areas of the wrinkle 501 shown in FIG. 5A).

Figure 5B:
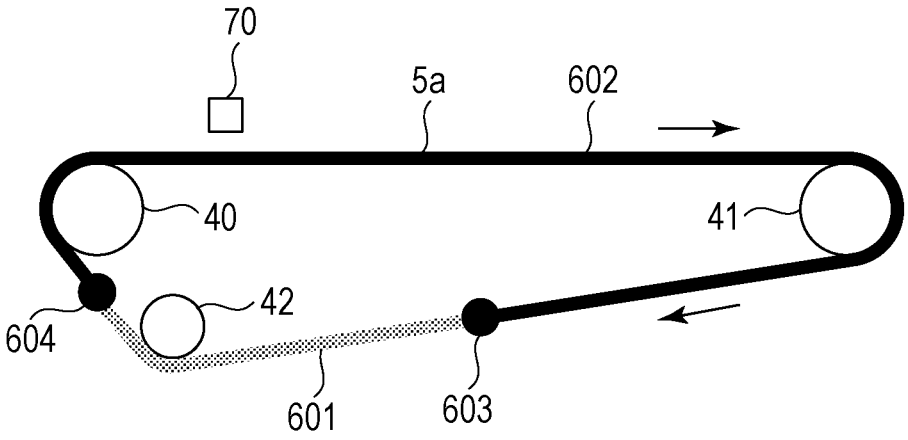

FIG. 5B illustrates a region in which a wrinkle, which is an area to which a toner image is not transferred, is formed and a region in which a toner image is formed. Note that the terms "area into which a toner image is not transferred" and "area into which a toner image is transferred" are used for describing an example case in which a toner image having an A4 size is transferred onto an intermediate transfer belt. According to the embodiment, for example, the circumferential length of the intermediate transfer belt 5*a* is 377 mm, the sheet size (an image size) that is most frequently used is A4 (a width of 210 mm and a length of 297 mm). Then, control is performed so that an image is formed without using a wrinkle portion. That is, the length of an area 504 into which a toner image is transferred is 297 mm. The length of an area 503 into which a toner image is not transferred is 80 mm (=377−297 mm). A leading edge 505 and a trailing edge 506 of the area 504 into which a toner image is transferred are also shown. Note that for ease of description, the circumferential length of the intermediate transfer belt 5*a* is set to 377 mm, and the image size is set to A4. However, if the circumferential length of the intermediate transfer belt 5*a* allows a wrinkle to be formed in the area 601 into which a toner image is not transferred, any circumferential length and image size can be employed.

Figure 6:
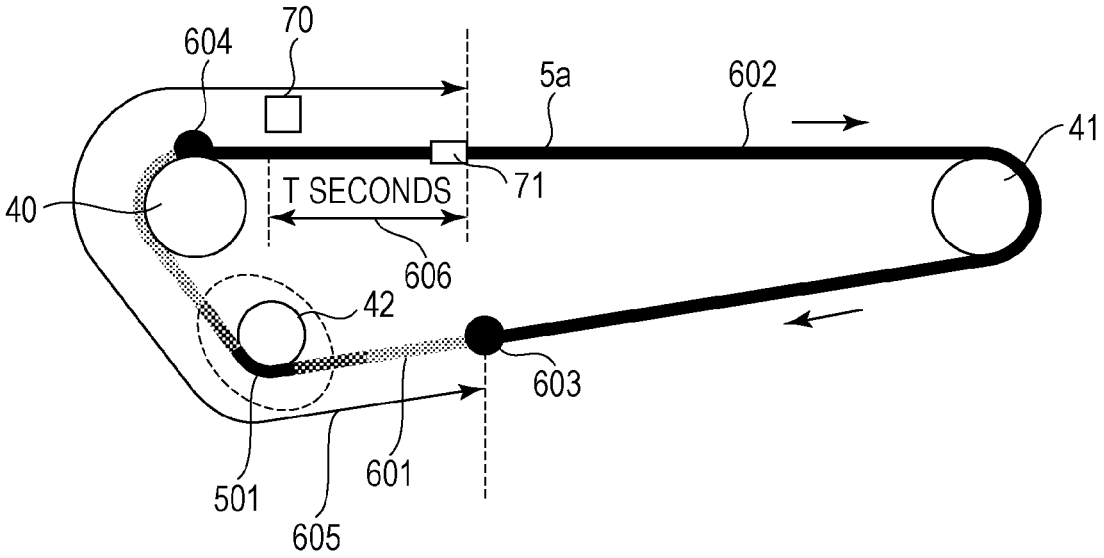
FIG. 6 illustrates the position at which an intermediate transfer belt is stopped.

FIG. 6 illustrates a technique for controlling a position at which the intermediate transfer belt 5*a* stops. After image formation has been completed, the intermediate transfer belt 5*a* is stopped after a predetermined period of time has elapsed since the detection sensor 70 detected the reference mark 71. In this way, the positions at which the intermediate transfer belt 5*a* is stopped are made the same. Accordingly, the position of the wrinkle formed in the intermediate transfer belt 5*a* can be within the area in which a toner image is not intended to be transferred.

According to the present embodiment, when the intermediate transfer belt 5*a* is stopped, the intermediate transfer belt 5*a* is stopped after T seconds have elapsed since the detection sensor 70 detected the reference mark 71. The value of T is determined so that a wrinkle is formed in the intermediate transfer belt 5*a* at a predetermined position. Note that the value of T (sec) can be appropriately determined in accordance with the conditions, such as the circumferential length of the intermediate transfer belt 5*a*, the driving speed of the intermediate transfer belt 5*a*, and the maximum size of the formed image.

Figure 7:
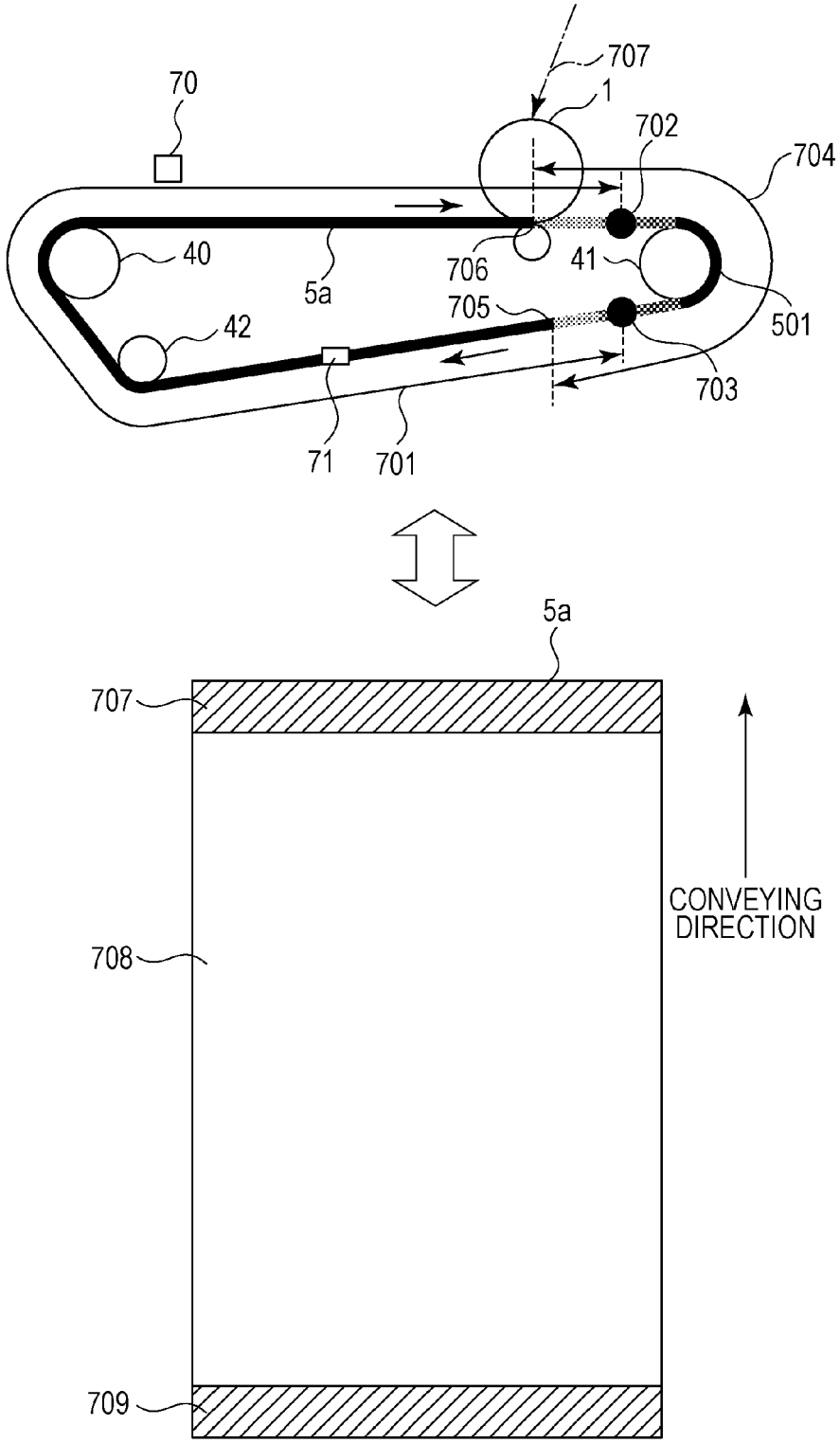
FIG. 7 illustrates a technique for transferring a toner image having a LEGAL size onto an intermediate transfer belt.

FIG. 7 illustrates a technique for transferring a toner image having a LEGAL size onto the intermediate transfer belt 5*a*. As described above, the circumferential length of the intermediate transfer belt 5*a* is 377 mm, the sheet size (an image size) that is most frequently used is A4 (a width of 210 mm and a length of 297 mm). Then, control is performed so that an image is formed while avoiding a wrinkle. That is, an area into which the toner image is transferred is 297 mm in length, and an area into which the toner image is not intended to be transferred is 80 mm (=377−297 mm) in length. If, under such conditions, a sheet (an image) having a LEGAL size (a width of 215.9 mm and a length of 355.6 mm) is used, an area into which the toner image is transferred is 355.6 mm in length, and an area into which the toner image is not intended to be transferred is 21.4 mm (=377−355.6 mm) in length. That is, when a toner image having a LEGAL size is formed, the toner image does not fit the area into which a toner image having an A4 size is transferred. Therefore, it is difficult to transfer the toner image onto the intermediate transfer belt 5*a* while avoiding the wrinkle of the intermediate transfer belt 5*a*.

A technique for transferring a toner image having a LEGAL size onto the intermediate transfer belt 5*a* according to the present embodiment is described next. If a toner image having a LEGAL size is transferred onto the intermediate transfer belt 5*a* at the same timing as a toner image having an A4 size, the toner image is transferred into an area in which a toner image having an A4 size is not transferred. Therefore, most part of the trailing edge of the image having a LEGAL size is transferred so as to overlap a wrinkle. At that time, if the wrinkle has a significant negative impact on the image, an image defect occurs in the trailing edge of the image. To address such a problem, according to the present embodiment, when a toner image larger than an A4 size (e.g., a toner image having a LEGAL size) is transferred onto the intermediate transfer belt 5*a*, transfer of the toner image is started slightly earlier than that for a toner image having an A4 size. In this way, an area of the toner image that overlaps a wrinkle of the intermediate transfer belt 5*a* is divided into the leading edge and the trailing edge portions. More specifically, as shown in FIG. 7, the leading edge 707 and the tailing edge 709 overlap a wrinkle. Even when the wrinkle has a negative impact on the toner image, the negative impact is divided between the leading edge and the trailing edge portions. Thus, the image defect can be made unnoticeable. As described above, even when a toner image having a size that is difficult to avoid a wrinkle formed in the intermediate transfer belt 5*a* is transferred onto the intermediate transfer belt 5*a*, control is performed so that the negative impact of the wrinkle on the toner image can be minimized. Thus, the negative impact of the wrinkle can be reduced.

While description has been made with reference to a single wrinkle point, a plurality of wrinkle points can be set. If a plurality of wrinkle points are employed, a negative impact of a wrinkle can be separated into a plurality of positions and can be reduced, although the number of wrinkles is increased. Wrinkles can be formed at a plurality of positions by appropriately increasing or decreasing the value of T seconds, which is, as illustrated in FIG. 6, used for stopping the intermediate transfer belt 5*a*. Note that the sizes of the leading edge and the trailing edge are not necessarily the same. The sizes of the overlapping areas at the leading edge and the trailing edge may be appropriately determined.

Figure 8:
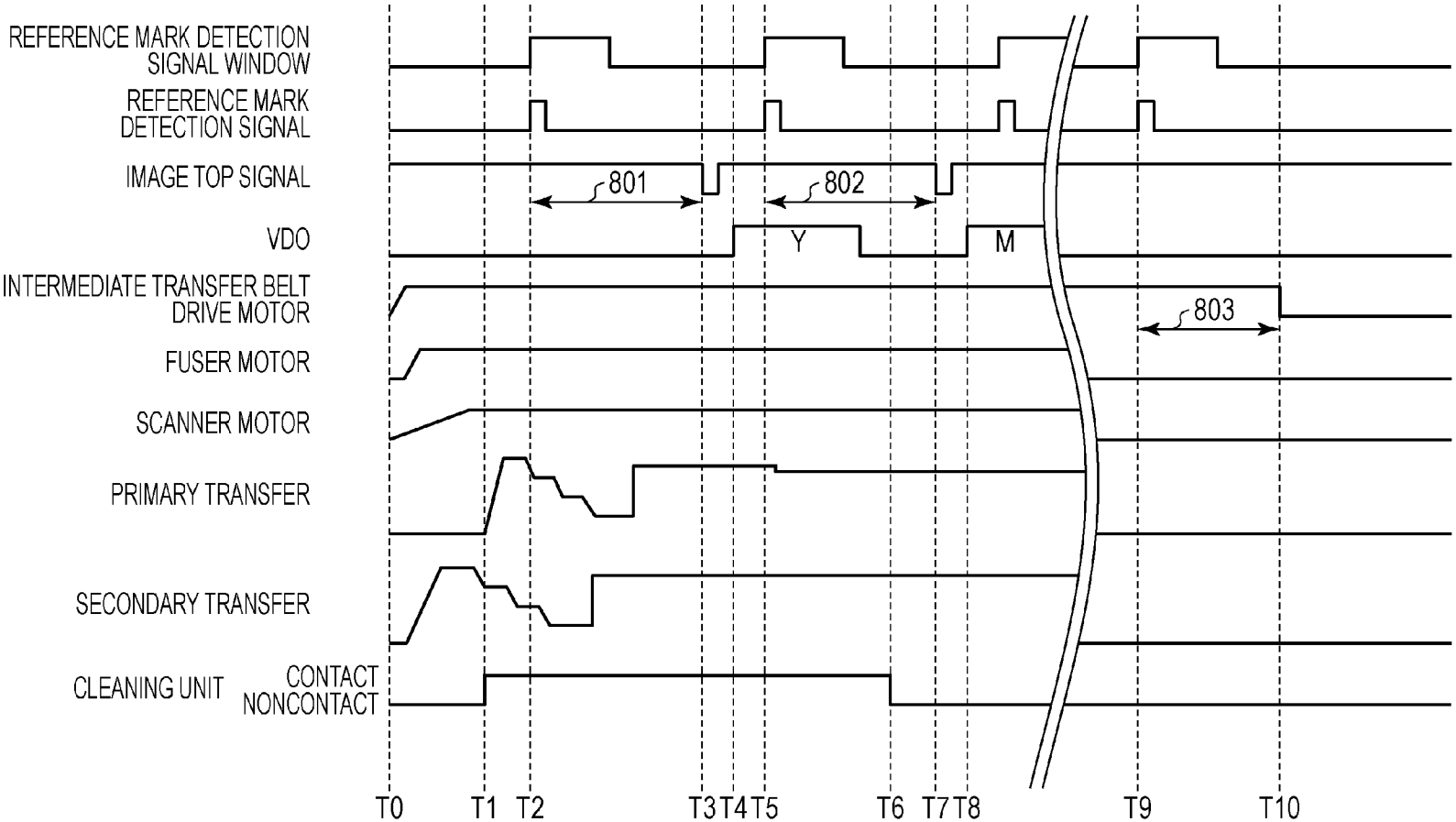
FIG. 8 is a timing diagram illustrating points in time that allow the leading edge and the trailing edge of an image to overlap a wrinkle formed in an intermediate transfer belt.

FIG. 8 is a timing diagram illustrating the operation in which a toner image is transferred so that the leading edge and the trailing edge overlap a wrinkle of the intermediate transfer belt 5*a*. Upon receiving an image formation command, the CPU 121 starts a preparation operation before starting an image forming operation. The preparation operation includes driving a variety of actuators, such as an intermediate transfer belt drive motor, a fuser motor, and a scanner motor, controlling adjustment of a secondary transfer bias, and applying a variety of high voltages (T0). When starting the scanner motor, a laser beam is forcibly emitted. Thus, a voltage difference is generated in the surface of the photosensitive drum 1. If, at that time, primary transfer control is performed, the primary transfer cannot be sufficiently controlled. Accordingly, primary transfer is started after the voltage difference disappears (T1). In addition, after adjustment of secondary transfer bias is completed, a cleaning unit is brought into contact with the intermediate transfer belt 5*a*. Thus, cleaning of the intermediate transfer belt 5*a* is performed until image formation is started. Note that cleaning of the intermediate transfer belt 5*a* using the cleaning unit in contact therewith is performed only in a preparation operation for a first page. A cleaning operation is not performed for pages subsequent to a second page in continuous page printing. In addition, although the period of time required for the preparation operation slightly varies from time to time, the preparation operation is completed within a period of time from T0 to T3.

At the same time as the preparation operation, in order to detect the reference mark 71 using the detection sensor 70, a monitoring operation for a reference mark is started. Hereinafter, a period of time during which the reference mark 71 is monitored using the detection sensor 70 is referred to as a "reference mark detection window". Start of the monitoring operation is referred to as "window open", and completion of the monitoring operation is referred to as "window close". In order to start monitoring a reference mark, a reference mark detection window is opened, and detection continues until the detection sensor 70 detects the reference mark 71. After a predetermined period of time has elapsed since the detection sensor 70 detected the reference mark 71 (T2), the CPU 121 outputs an image TOP signal to the video controller 102 (T3). The period of time is a time up to a transfer start time 801 and is determined so that the leading edge and the trailing edge of the toner image can be transferred into an area in which a wrinkle is formed. For example, if an image TOP signal is output for a toner image having an A4 size at a point in time when transfer of the toner image starts at the trailing edge of the area in which a wrinkle is formed, the image TOP signal is output for a toner image having a LEGAL size at a point in time slightly earlier than that for a toner image having an A4 size. In this way, a toner image can be transferred so that the leading edge of the toner image overlaps a wrinkle. Note that how much the output of the image top signal is advanced can be freely determined in accordance with how much the toner image overlaps the wrinkle.

Thereafter, the CPU 121 receives a VDO signal (a video signal) from the video controller 102 and starts formation of a Y toner image (T4). The Y toner image formed on the photosensitive drum 1 is transferred onto the intermediate transfer belt 5*a* so that the leading edge and the trailing edge overlap the wrinkle. Subsequently, the cleaning unit is moved away from the intermediate transfer belt 5*a* before the Y toner image reaches the cleaning unit (T6).

If a reference mark detection window for a second revolution is opened during formation of the Y toner image and the detection sensor 70 detects the reference mark 71 (T5), the CPU 121 outputs an image TOP signal to the video controller 102 when the time 802 that allows the leading edge and the trailing edge of a toner image to be transferred to the position of a wrinkle has elapsed since the detection sensor 70 detected the reference mark 71 (T7), as in the formation of the Y image. Thereafter, the CPU 121 receives a VDO signal from the video controller 102 and starts forming an M toner image (T8). Subsequently, the CPU 121 performs formation of a C toner image and a Bk toner image in a similar manner. Thus, a color image is formed on the intermediate transfer belt 5*a*.

The operation for stopping the intermediate transfer belt 5*a* after an image forming operation has been completed is described next. After preparation for stopping the intermediate transfer belt 5*a* has been completed, the CPU 121 opens the reference mark detection window and waits until the reference mark 71 is detected by the detection sensor 70. Upon detecting the reference mark 71 (T9), the CPU 121 stops the intermediate transfer belt 5*a* (T10) when a predetermined period of time 803 preset for forming a wrinkle at a predetermined position elapses.

Figure 9:
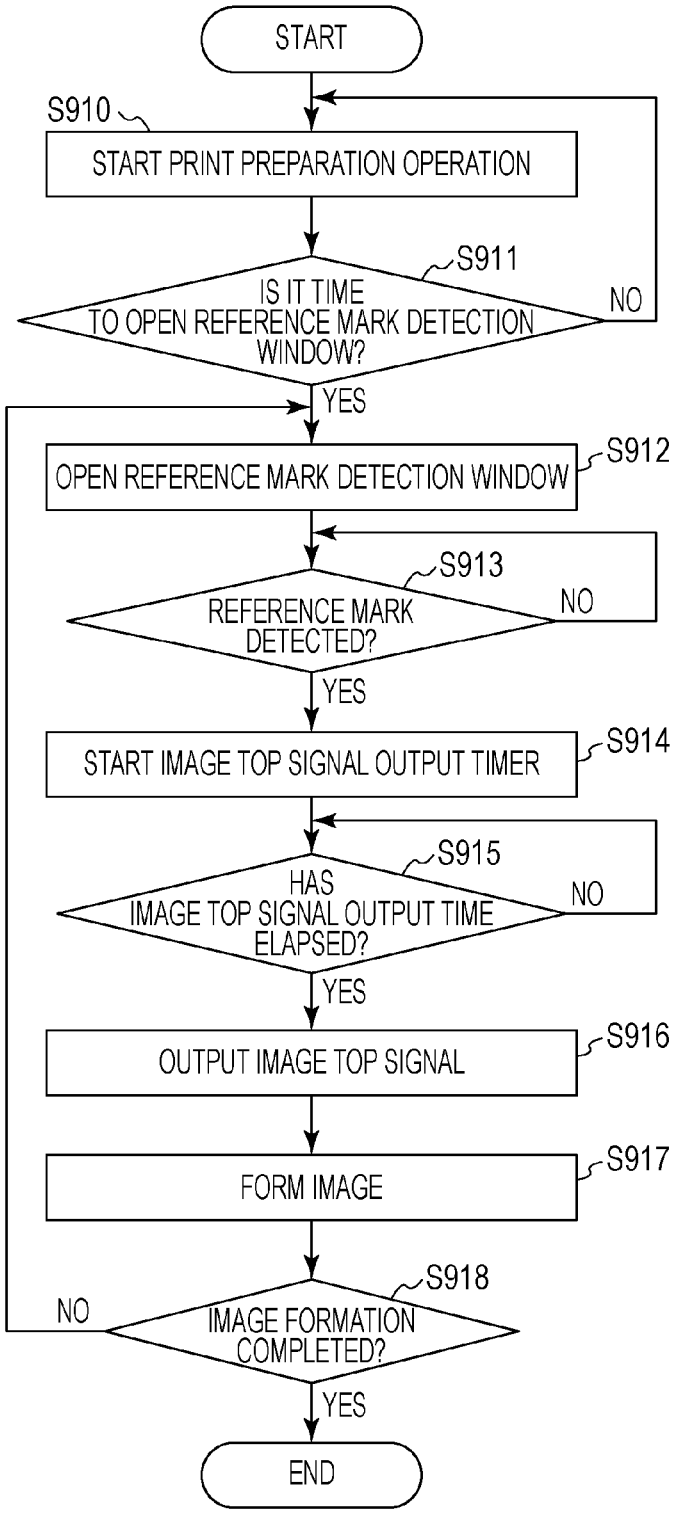
FIG. 9 is a flowchart illustrating a technique for overlapping the leading edge and the trailing edge of an image on a wrinkle formed in an intermediate transfer belt.

FIG. 9 is a flowchart of a technique for transferring an image so that the leading and trailing edges of the image overlap a wrinkle of the intermediate transfer belt 5*a*. In step S910, upon receiving an image formation start command from the video controller 102, the CPU 121 starts a preparation operation before starting an image forming operation. The preparation operation includes starting actuators, such as the intermediate transfer belt drive motor, and applying high voltages used for primary transfer control and secondary transfer control. In step S911, the CPU 121 determines whether it is the time to open the reference mark detection window. If it is the time to open the reference mark detection window, the CPU 121, in step S912, opens the reference mark detection window. In step S913, the CPU 121 continues detection until the detection sensor 70 detects the reference mark 71. If the detection sensor 70 detects the reference mark 71, the CPU 121 starts an image TOP signal output timer for a Y image in step S914. If, in step S915, the image TOP signal output timer indicates that a predetermined image top signal output time has come (i.e., if the period of time 801 from when the reference mark 71 is detected to when the leading edge and the trailing edge of a toner image can be transferred onto the wrinkle, as illustrated in the timing diagram shown in FIG. 8, has elapsed), the CPU 121, in step S916, outputs an image TOP signal to the video controller 102. In step S917, the CPU 121 receives a VDO signal from the video controller 102 and forms a toner image on the basis of the VDO signal. In step S918, as in the Y image formation, the CPU 121 sequentially performs formation of an M toner image, a C toner image, and a Bk toner image.

Figure 10:
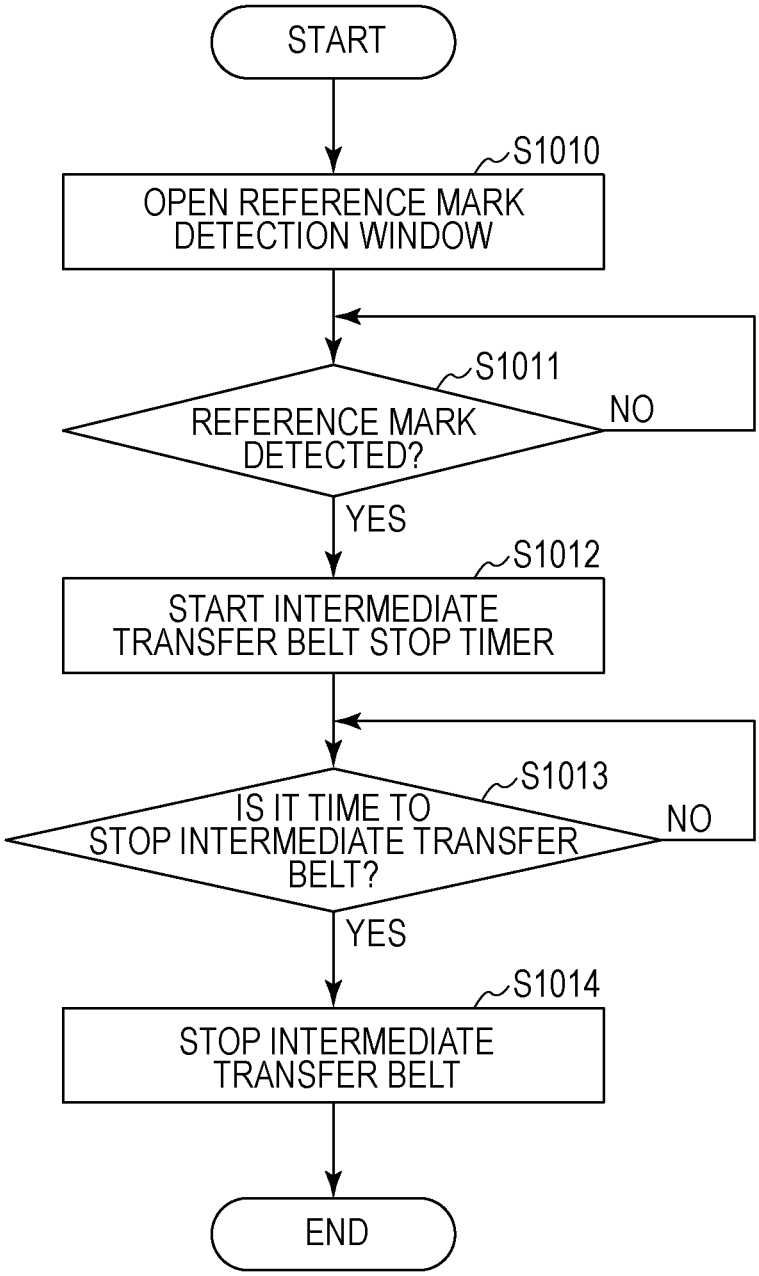
FIG. 10 is a flowchart illustrating a technique for forming a wrinkle of the intermediate transfer belt 5*a* at a predetermined position.

FIG. 10 is a flowchart illustrating a technique for forming a wrinkle at a predetermined position of the intermediate transfer belt 5*a*. In step S1010, the CPU 121 opens the reference mark detection window after preparation for stopping the intermediate transfer belt 5*a* has been completed. Upon detecting the reference mark 71 using the detection sensor 70 in step S1011, the CPU 121, in step S1012, starts an intermediate transfer belt stop timer. If, in step S1013, the intermediate transfer belt stop timer indicates that a preset intermediate transfer belt stop time has come, the CPU 121, in step S1014, stops driving of the intermediate transfer belt 5*a*.

As described above, even when a toner image having such a large size that a toner image overlaps a wrinkle formed in the intermediate transfer belt 5*a* is formed, transfer control is performed so that the leading edge and the trailing edge of the toner image overlap the wrinkle. In this way, the probability of the occurrence of an image defect can be reduced.

While the present embodiment has been described with reference to a technique for overlaying the leading edge and the trailing edge of a toner image having a LEGAL size on a wrinkle, not only a toner image is overlaid on the wrinkle. When an image is formed on a recording material having a LEGAL size, control can be performed so that the leading edge and the trailing edge of the recording material are overlaid on a wrinkle. In this way, the same effect can be obtained. That is, when a toner image formed on the intermediate transfer belt 5*a* is transferred onto a recording material in the secondary transfer unit and if control is performed so that the leading edge and the trailing edge of the recording material overlap a wrinkle, a toner image having a large size so as to overlap a wrinkle is transferred onto the intermediate transfer belt 5*a* as for a recording material. In addition, a toner image having a size so as not to overlap a wrinkle is transferred onto the intermediate transfer belt 5*a* at a position at which the toner image does not overlap the wrinkle. In this way, the probability of the occurrence of an image defect can be reduced.

Second Embodiment

The first embodiment has been described with reference to a technique for overlaying the leading edge and the trailing edge of a toner image on a wrinkle when the toner image is forced to overlap the wrinkle.

According to a second embodiment, a technique is described for overlapping a toner image on a wrinkle by forming wrinkles at a plurality of positions regardless of the size of the formed image and, therefore, distributing wrinkles and overlaying the toner image on the wrinkle if the image having such a large size that the toner image overlaps the wrinkle is formed. Note that descriptions of the configuration of an apparatus and units that are similar to those of the first embodiment, such as the image forming apparatus and the intermediate transfer belt 5*a*, are not repeated. For ease of description, in this embodiment, an image having a LEGAL size is formed. However, the circumferential length of the intermediate transfer belt 5*a* and the image size are not limited thereto if a toner image is forced to be transferred onto a wrinkle of the intermediate transfer belt 5*a*.

Figure 11:
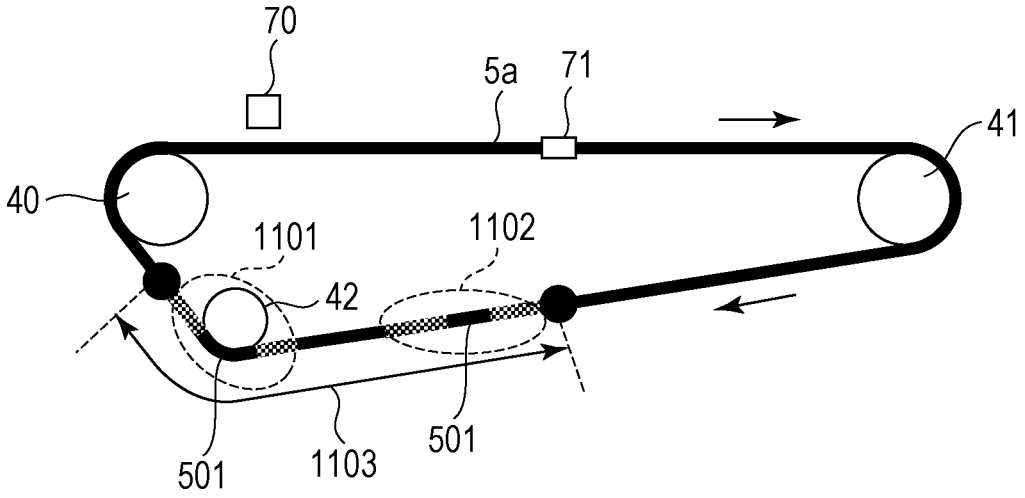
FIG. 11 illustrates the intermediate transfer belt having two stop positions.

FIG. 11 illustrates the intermediate transfer belt 5*a* having two stop positions according to the present embodiment. As illustrated in FIGS. 5A and 5B of the first embodiment, the circumferential length of the intermediate transfer belt 5*a* is set to 377 mm, and the sheet size (an image size) that is most frequently used is set to A4 (a width of 210 mm and a length of 297 mm). Then, an image is formed without using a wrinkle portion. Accordingly, the length of an area into which a toner image is transferred is 297 mm. The length of an area into which a toner image is not intended to be transferred is 80 mm (=377−297 mm). In addition, the length of a nip in which the intermediate transfer belt 5*a* is in contact with the support roller 42 is 15 mm, and a variation in the stop position of the intermediate transfer belt motor is 6 mm. Thus, the length of a wrinkle is 21 mm (=15 mm+6 mm). Under such conditions, wrinkles are formed at a plurality of positions in the area into which a toner image is not intended to be transferred, and wrinkles are distributed over the intermediate transfer belt 5*a*. In this way, control can be performed so that a negative impact of a wrinkle on an image is minimized.

As shown in FIG. 11, in an area 1103 into which a toner image is not intended to be transferred, the intermediate transfer belt 5*a* is stopped at two positions. Thus, wrinkles are formed at two positions 1101 and 1102. Thereafter, by switching the stop position between the two positions regardless of the formed image size, wrinkles are distributed. According to the present embodiment, wrinkles are formed at two positions. However, if possible, by increasing the number of positions at which wrinkles are formed, wrinkles can be further distributed.

When a toner image having a LEGAL size (a width of 215.9 mm and a length of 355.6 mm) is formed under such conditions, the length of the area into which the toner image is transferred is 355.6 mm, and the length of the area into which the toner image is not intended to be transferred is 21.4 mm (=377−355.6 mm). Therefore, part of the image overlaps a wrinkle formed in the intermediate transfer belt 5*a*. At that time, if wrinkles are formed at a plurality of positions, a negative impact of a wrinkle on an image can be reduced. Thus, one of the leading edge and the trailing edge of the image may overlap the wrinkle. However, by overlaying the leading edge and the trailing edge of the image on the wrinkle as described in the first embodiment, a negative impact of a wrinkle on an image can be further reduced.

Figure 12:
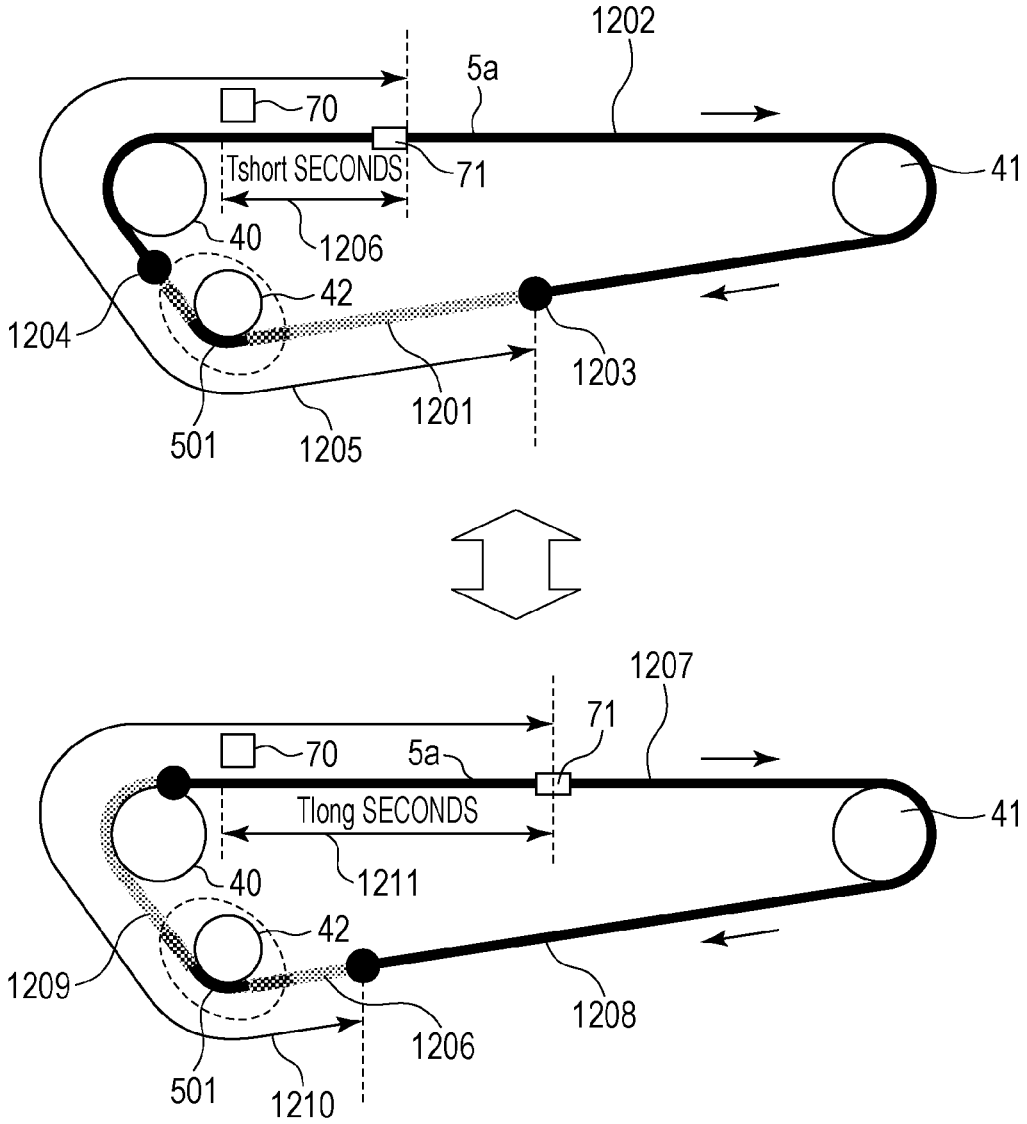
FIG. 12 illustrates two stop positions of the intermediate transfer belt.

FIG. 12 illustrates two stop positions of the intermediate transfer belt 5*a* determined in order to distribute wrinkles. In order to form a wrinkle at the leading edge 1204 of an area into which a toner image is not intended to be transferred, the intermediate transfer belt 5*a* is stopped after Tshort seconds have elapsed since the detection sensor 70 detected the reference mark 71. In contrast, in order to form a wrinkle at the trailing edge 1206 of the area into which a toner image is not intended to be transferred, the intermediate transfer belt 5*a* is stopped after Tlong seconds have elapsed since the detection sensor 70 detected the reference mark 71. Hereinafter, the stop position determined when the intermediate transfer belt 5*a* is stopped after Tlong seconds have elapsed is referred to as a "stop position 1", and the stop position determined when the intermediate transfer belt 5*a* is stopped after Tshort seconds have elapsed is referred to as a "stop position 2". In this way, by employing two stop positions, wrinkles can be distributed.

Figure 13:
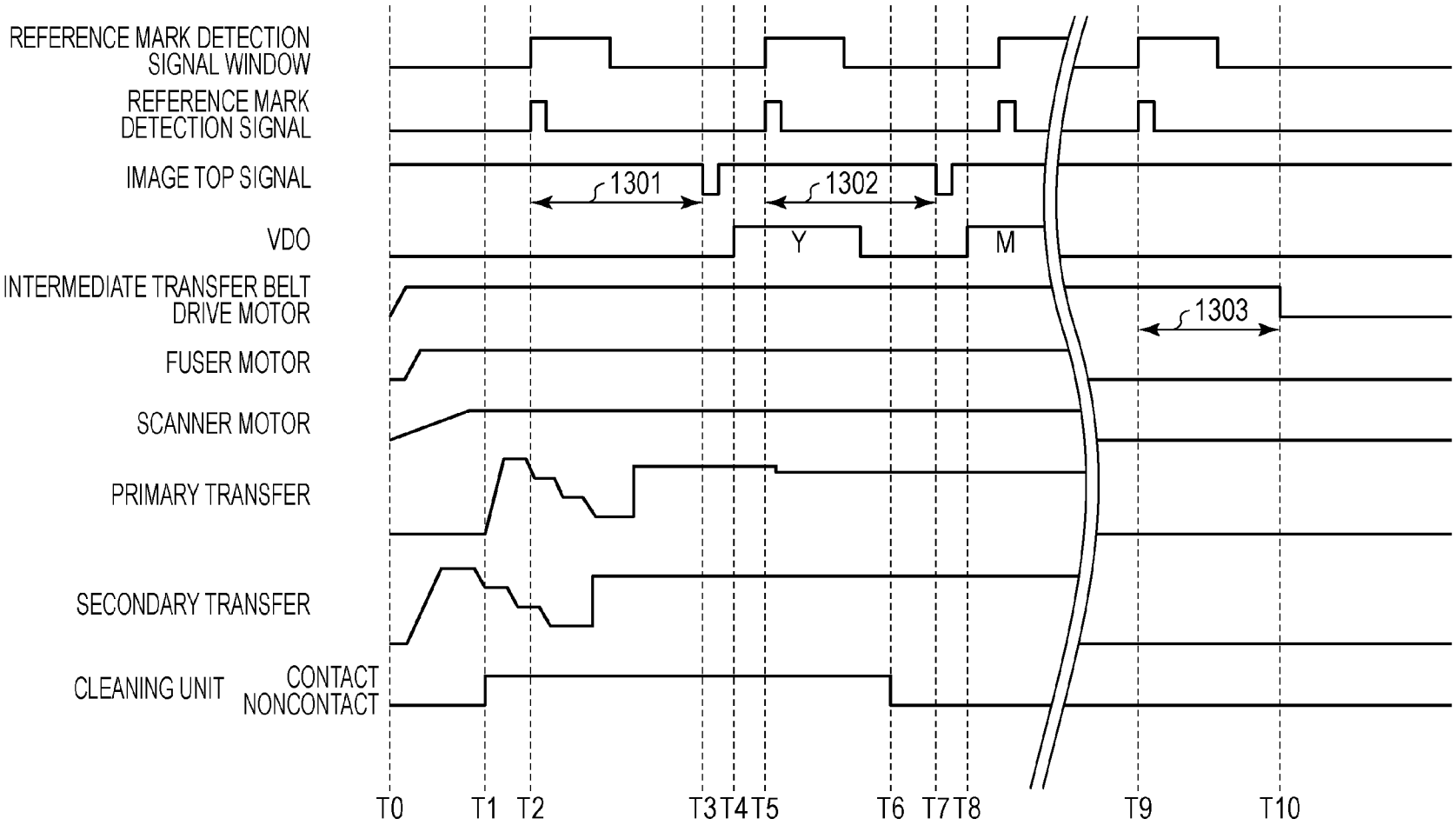
FIG. 13 is a timing diagram illustrating the points in time that allow the leading edge and the trailing edge of an image to overlap a wrinkle formed in an intermediate transfer belt when wrinkles are distributed over the intermediate transfer belt.

FIG. 13 is a timing diagram illustrating a transfer timing when wrinkles are distributed over the intermediate transfer belt 5*a* and the leading edge and the trailing edge of an image overlap the wrinkle.

Upon receiving an image formation command, the CPU 121 starts a preparation operation before starting an image forming operation (T0). The preparation operation includes driving a variety of actuators, such as an intermediate transfer belt drive motor, a fuser motor, and a scanner motor, controlling adjustment of a secondary transfer bias, and applying a variety of high voltages. When starting the scanner motor, a laser beam is forcibly emitted. Thus, a voltage difference is generated in the surface of the photosensitive drum 1. If, at that time, primary transfer control is performed, the primary transfer cannot be sufficiently controlled. Accordingly, primary transfer is started after the voltage difference disappears (T1). In addition, after adjustment of secondary transfer bias has been completed, a cleaning unit is brought into contact with the intermediate transfer belt 5*a*. Thus, cleaning of the intermediate transfer belt 5*a* is performed until image formation is started. Note that cleaning of the intermediate transfer belt 5*a* using the cleaning unit in contact therewith is performed only in a preparation operation for a first page. A cleaning operation is not performed for pages subsequent to a second page in continuous page printing. In addition, although the period of time required for the preparation operation slightly varies from time to time, the preparation operation is completed within a period of time from T0 to T3.

At the same time as the preparation operation, in order to detect the reference mark 71 using the detection sensor 70, a monitoring operation for a reference mark is started. In order to start monitoring a reference mark, a reference mark detection window is opened, and detection continues until the detection sensor 70 detects the reference mark 71. After the detection sensor 70 has detected the reference mark 71 (T2) and a predetermined period of time has elapsed, the CPU 121 outputs an image TOP signal to the video controller 102 (T3). The predetermined period of time is a time up to a transfer start time 801 and is determined so that the leading edge and the trailing edge of the toner image can be transferred into an area in which a wrinkle is formed. For example, if an image TOP signal is output for a toner image having an A4 size at a point in time when transfer of the toner image starts at the trailing edge of the area in which a wrinkle is formed, the image TOP signal is output for a toner image having a LEGAL size at a point in time slightly earlier than that for a toner image having an A4 size. In this way, a toner image can be transferred so that the leading edge of the toner image overlaps a wrinkle. Note that how much the output of the image top signal is advanced can be freely determined in accordance with how much the toner image overlaps the wrinkle.

Thereafter, the CPU 121 receives a VDO signal (a video signal) from the video controller 102 and starts formation of a Y toner image (T4). The Y toner image formed on the photosensitive drum 1 is transferred onto the intermediate transfer belt 5*a* so that the leading edge and the trailing edge of the toner image overlap the wrinkle. Subsequently, the cleaning unit is moved away from the intermediate transfer belt 5*a* before the Y toner image reaches the cleaning unit (T6).

If a reference mark detection window for a second revolution is opened during formation of the Y toner image and the detection sensor 70 detects the reference mark 71 (T5), the CPU 121 outputs an image TOP signal to the video controller 102 when the time 802 that allows the leading edge and the trailing edge of a toner image to be transferred to the position of a wrinkle has elapsed since the detection sensor 70 detected the reference mark 71 (T7), as in the formation of the Y image. Thereafter, the CPU 121 receives a VDO signal from the video controller 102 and starts forming an M toner image (T8). Subsequently, the CPU 121 performs formation of a C toner image and a Bk toner image in a similar manner. Thus, a color image is formed on the intermediate transfer belt 5*a*.

The operation for stopping the intermediate transfer belt 5*a* after an image forming operation has been completed is described next. After preparation for stopping the intermediate transfer belt 5*a* has been completed, the CPU 121 opens the reference mark detection window and waits until the reference mark 71 is detected by the detection sensor 70. Upon detecting the reference mark 71 (T5), the CPU 121 stops the intermediate transfer belt 5*a* after Tshort seconds have elapsed when image formation is started from the stop position 1. However, the CPU 121 stops the intermediate transfer belt 5*a* after Tlong seconds have elapsed when image formation is started from the stop position 2. A difference 1303 represents a difference between Tlong seconds and Tshort seconds.

Figure 14:
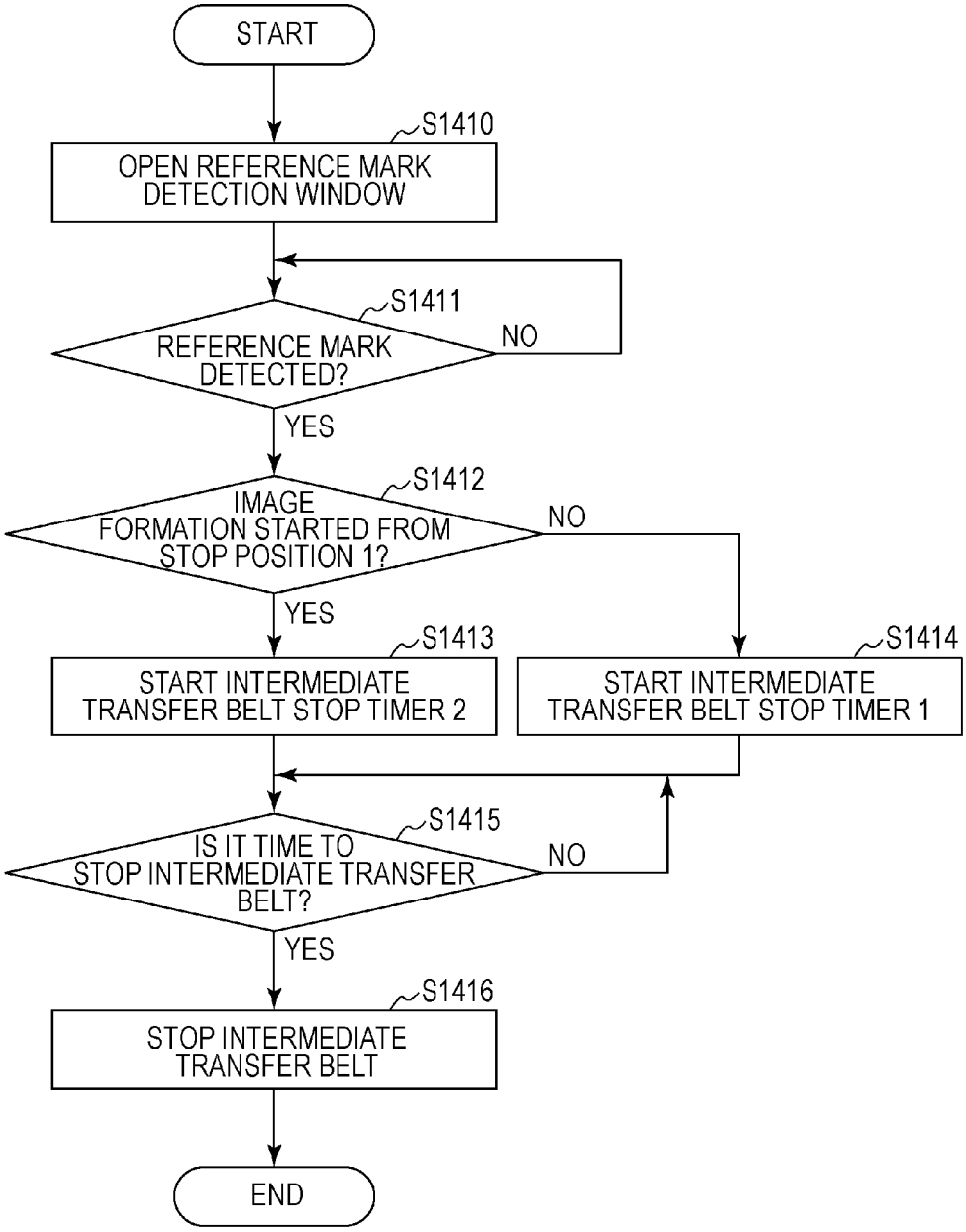
FIG. 14 is a flowchart illustrating a technique for forming wrinkles at two stop positions of the intermediate transfer belt.

FIG. 14 is a flowchart illustrating a technique for forming wrinkles at the stop positions 1 and 2 of the intermediate transfer belt 5*a*. In step S1410, the CPU 121 opens the reference mark detection window after preparation for stopping the intermediate transfer belt 5*a* has been completed. Upon detecting the reference mark 71 using the detection sensor 70 in step S1411, the CPU 121, in step S1412, determines whether the intermediate transfer belt 5*a* is driven from the stop position 1 in order to form an image. If the intermediate transfer belt 5*a* is driven from the stop position 1, the CPU 121, in step S1413, starts an intermediate transfer belt stop timer 2. However, if the intermediate transfer belt 5*a* is driven from the stop position 2, the CPU 121, in step S1414, starts an intermediate transfer belt stop timer 1. If, in step S1415, the intermediate transfer belt stop time has come, the CPU 121, in step S1416, stops driving of the intermediate transfer belt 5*a*.

In this way, a negative impact of a wrinkle can be distributed by forming wrinkles at a plurality of positions on the intermediate transfer belt 5*a* regardless of the size of a formed image. Accordingly, even when a toner image having such a size that the toner image is transferred onto a wrinkle of the intermediate transfer belt 5*a* is formed, a negative impact of the wrinkle on the toner image can be reduced. Furthermore, when a toner image having such a size that the toner image is transferred onto a wrinkle of the intermediate transfer belt 5*a* is formed, a negative impact of the wrinkle on the toner image can be reduced by controlling the transfer operation so that the leading edge and the trailing edge of the toner image overlap the wrinkle.

Third Embodiment

The first and second embodiments have been described with reference to the techniques for controlling the position to which a toner image is transferred so that the leading edge and the trailing edge of a toner image overlap a wrinkle formed in the intermediate transfer belt 5*a*. By performing control so that the leading edge and the trailing edge of a toner image overlap a wrinkle formed in the intermediate transfer belt 5*a*, a negative impact of the wrinkle on the toner image can be reduced. However, if one of the leading edge portion and the trailing edge portion that overlaps the wrinkle is longer than the other, a negative impact of the wrinkle on the toner image may be further reduced. According to a third embodiment, a technique for controlling the position of a toner image that overlaps a wrinkle of the intermediate transfer belt 5*a* in accordance with image information is described.

Figure 15:
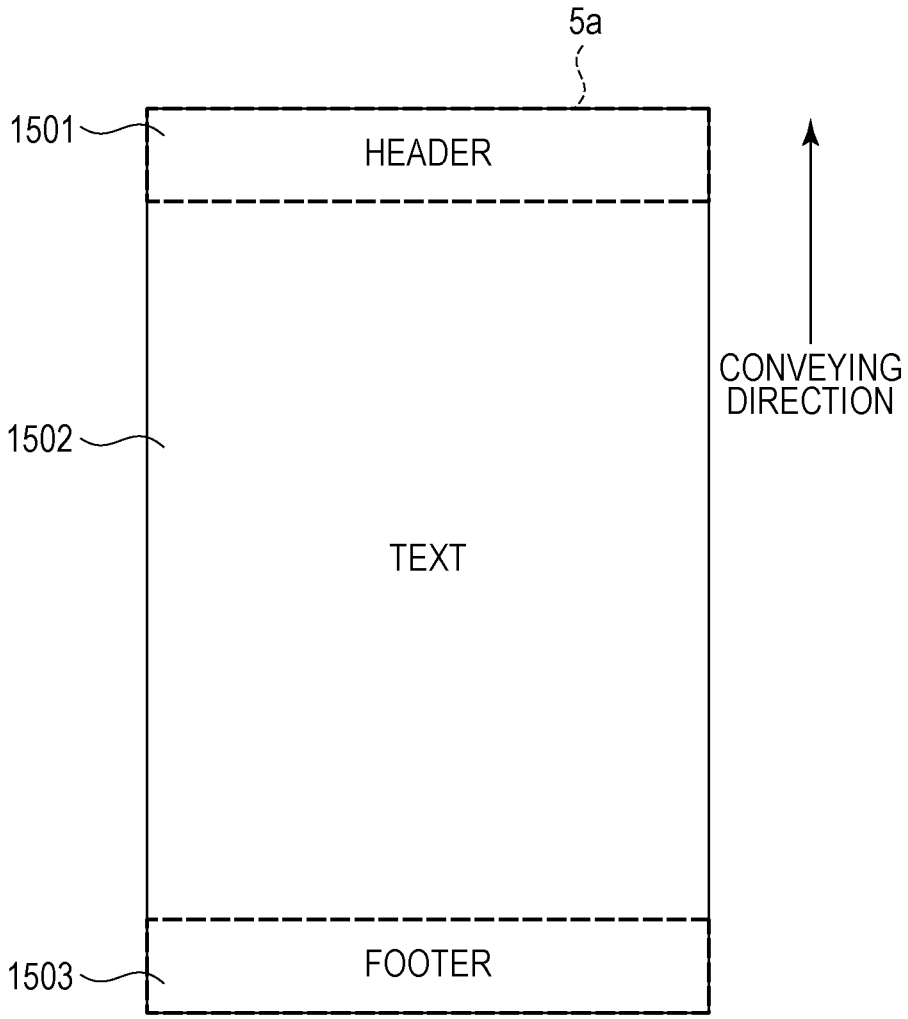
FIG. 15 illustrates a formed text page.

FIG. 15 illustrates a text page as an example of a formed image. In general, a text page has a header area 1501 at the leading edge thereof and a footer area 1503 at the trailing edge thereof. A text area 1502 is located between the header area 1501 and the footer area 1503. In general, the amount of printed information in the header area 1501 or the footer area 1503 is smaller than the amount of printed information in the text area 1502. In addition, in some cases, the header area 1501 and the footer area 1503 are blank areas. Accordingly, even when a wrinkle occurs in the header area 1501 and the footer area 1503 and, therefore, an image defect occurs, the level of negative impact on the image is low, as compared with a wrinkle occurring in the text area 1502. At that time, the CPU 121 can analyze what type of image is formed on the basis of image information transmitted from the video controller 102. If, for example, characters are printed in the header area 1501 but are not printed in the footer area 1503, the CPU 121 controls transfer of the toner image onto the intermediate transfer belt 5*a* so that the trailing edge of the toner image overlaps a wrinkle. By doing so, the negative impact of the wrinkle on the toner image can be further reduced. Note that for simplicity, description has been made with reference to image information representing a text page. However, image information is not limited to a text page. For example, even when a normal image other than a text page is formed, similar control can be performed using the area of a white space and the print ratio.

Figure 16B:
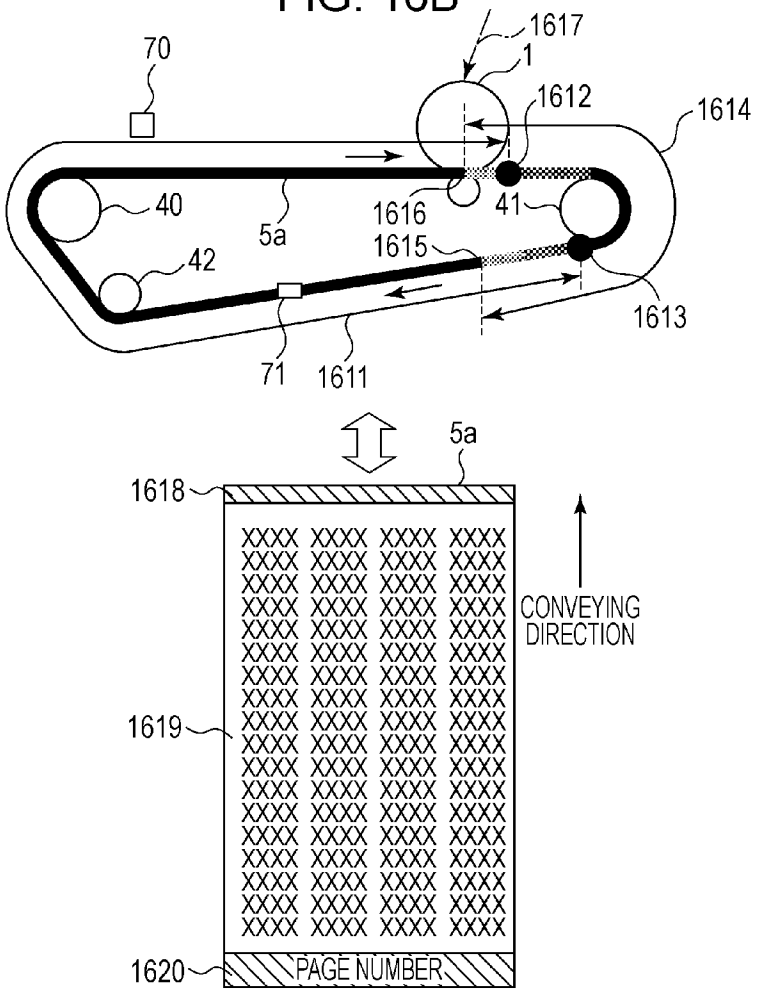
FIGS. 16A and 16B illustrate control of a position at which an image overlaps a wrinkle in accordance with the image information.
Figure 16A:
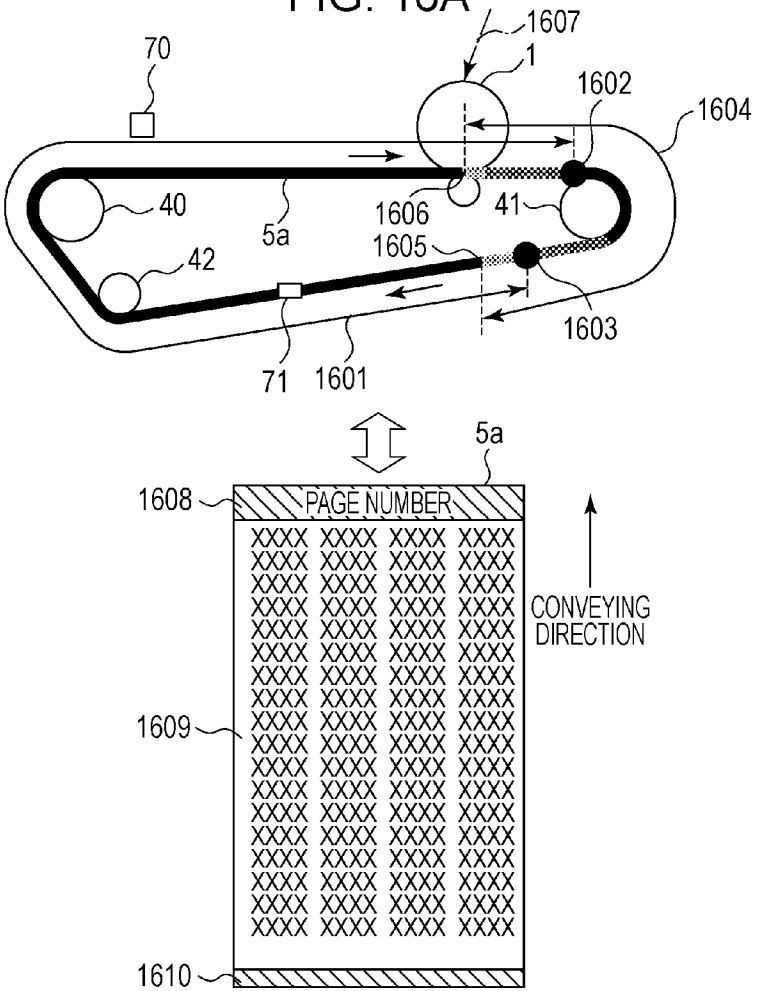

FIGS. 16A and 16B illustrate a technique for controlling the position of a toner image that overlaps a wrinkle of the intermediate transfer belt 5*a* in accordance with image information. A technique for making the leading edge portion that overlaps the wrinkle longer than the trailing edge portion that overlaps the wrinkle is described first. If it is determined that control is performed so that the leading edge portion that overlaps the wrinkle is longer than the trailing edge portion that overlaps the wrinkle, transfer of a toner image is started at a point in time that is slightly earlier than a point in time used when a toner image is transferred onto the intermediate transfer belt 5*a* so that the length of the leading edge portion that overlaps the wrinkle is the same as the length of the trailing edge portion that overlaps the wrinkle. That is, transfer of a toner image is started at a point 1602 and ends at a point 1603. Note that a specific period of time used for delaying the transfer timing can be freely determined in accordance with the length of the trailing edge portion that overlaps a wrinkle.

A technique for making the trailing edge portion that overlaps the wrinkle longer than the leading edge portion that overlaps the wrinkle is described next. If it is determined that control is performed so that the trailing edge portion that overlaps the wrinkle is longer than the leading edge portion that overlaps the wrinkle, transfer of a toner image is started at a point in time that is slightly delayed from a point in time used when a toner image is transferred onto the intermediate transfer belt 5*a* so that the length of the leading edge portion that overlaps the wrinkle is the same as the length of the trailing edge portion that overlaps the wrinkle. That is, transfer of a toner image is started at a point 1612 and ends at a point 1613. Note that a particular period of time used for delaying the transfer timing can be freely determined in accordance with the length of the trailing edge portion that overlaps a wrinkle.

By controlling the position at which an image overlaps a wrinkle using image information in this manner, the probability of the occurrence of an image defect can be reduced. Note that while the present embodiment has been described with reference to the leading edge and the trailing edge overlapping a wrinkle, both leading edge and trailing edge need not overlap a wrinkle. For example, control can be performed so that only one of the leading edge and the trailing edge overlaps a wrinkle in accordance with the image information.

Figure 17:
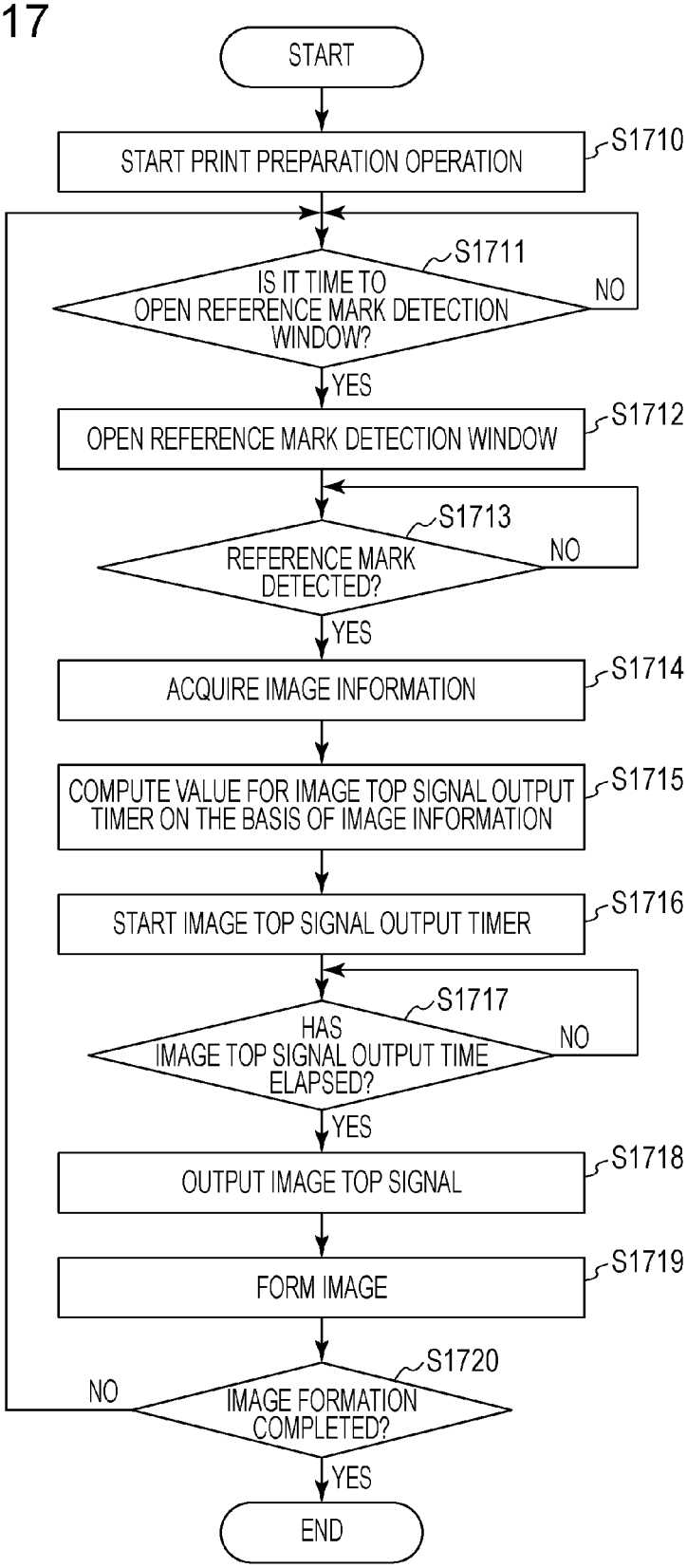
FIG. 17 illustrates a technique for controlling the position at which an image overlaps a wrinkle in accordance with the image information.

FIG. 17 is a flowchart of a technique for controlling the position at which an image overlaps a wrinkle in accordance with the image information. In step S1710, upon receiving an image formation start command from the video controller 102, the CPU 121 starts a preparation operation before starting an image forming operation. The preparation operation includes starting actuators, such as the intermediate transfer belt drive motor, and applying high voltages used for primary transfer control and secondary transfer control. In step S1711, the CPU 121 determines whether it is the time to open the reference mark detection window. If it is the time to open the reference mark detection window, the CPU 121, in step S1712, opens the reference mark detection window. In step S1713, the CPU 121 continues detection until the detection sensor 70 detects the reference mark 71. If the detection sensor 70 detects the reference mark 71, the CPU 121, in step S1714, acquires the image information. In step S1715, the CPU 121 computes the value for the image TOP signal output timer on the basis of the acquired image information in order to control the position at which the image overlaps a wrinkle. At that time, computation is performed so that the value set when the length of the leading edge portion of the image that overlaps the wrinkle is longer than the length of the trailing edge portion that overlaps the wrinkle is less than the value set when the length of the trailing edge portion of the image that overlaps the wrinkle is longer than the length of the leading edge portion that overlaps the wrinkle. In step S1716, the CPU 121 starts the image TOP signal output timer for the Y image. In step S1717, if the image TOP signal output timer indicates that a predetermined image top signal output time has come, the CPU 121, in step S1718, outputs an image TOP signal to the video controller 102. In step S1719, the CPU 121 receives a VDO signal from the video controller 102 and forms a toner image on the basis of the VDO signal. In step S1720, as in the image formation of a Y toner image, the CPU 121 sequentially performs formation of an M toner image, a C toner image, and a Bk toner image.

In this way, even when a toner image is forced to overlap a wrinkle formed in the intermediate transfer belt 5*a*, the probability of the occurrence of an image defect can be reduced by controlling the position of the toner image at which the toner image overlaps the wrinkle in accordance with the image information.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185087 filed Aug. 20, 2010, which is hereby incorporated by reference herein in its entirety.

What is claimed is:

1. An image forming apparatus comprising:

an image bearing member;

a developing unit configured to develop a latent image formed on the image bearing member into a toner image;

an intermediate transfer member;

a transfer unit configured to transfer the toner image formed on the image bearing member onto the intermediate transfer member;

a tension member configured to support the intermediate transfer member; and a control unit configured to control a point in time at which the transfer unit transfers the toner image so that the leading edge and trailing edge of the toner image overlap an imprint portion formed in the intermediate transfer member by the tension member.

2. The image forming apparatus according to claim 1, wherein the control unit controls a position at which the intermediate transfer member stops so that the imprint portion is formed within a predetermined range of the intermediate transfer member.

3. The image forming apparatus according to claim 2, wherein the control unit controls a position at which the intermediate transfer member stops so that a plurality of the imprint portion are formed within a predetermined range of the intermediate transfer member.

4. The image forming apparatus according to claim 1, further comprising:

a receiving unit configured to receive image information used for forming the toner image;

wherein the control unit analyzes the image information and performs control so that part of the formed toner image that is not sensitive to a negative impact of an imprint portion overlaps the imprint portion.

5. An image forming apparatus comprising:

an image bearing member;

a developing unit configured to develop a latent image formed on the image bearing member into a toner image using a developer;

an intermediate transfer member;

a transfer unit configured to transfer the toner image formed on the image bearing member onto the intermediate transfer member;

a tension member configured to support the intermediate transfer member;

a reference mark marked on the intermediate transfer member and used for controlling the position of the intermediate transfer member;

a detecting unit configured to detect the reference mark marked on the intermediate transfer member; and a control unit configured to perform control so that the transfer unit transfers the toner image onto the intermediate transfer member after a predetermined period of time has elapsed since the detecting unit detected the reference mark; and a receiving unit configured to receive image information used for forming the toner image, wherein the control unit analyzes the image information and performs control so that part of the formed toner image that is not sensitive to a negative impact of an imprint portion overlaps the imprint portion.

6. The image forming apparatus according to claim 5, wherein when transferring a toner image having such a large size that the toner image is transferred into an area into which the toner image is not intended to be transferred, the control unit controls a point in time at which the transfer unit transfers the toner image so that one of the leading edge and the trailing edge of the toner image having the large size is transferred onto the imprint portion.

7. The image forming apparatus according to claim 5, wherein when transferring a toner image having such a large size that the toner image is transferred into an area into which the toner image is not intended to be transferred, the control unit controls a point in time at which the transfer unit transfers the toner image so that the leading edge and the trailing edge of the toner image having the large size are transferred onto the imprint portion.

8. An image forming apparatus comprising:

an image bearing member;

a developing unit configured to develop a latent image formed on the image bearing member into a toner image;

an intermediate transfer member;

a primary transfer unit configured to transfer the toner image formed on the image bearing member onto the intermediate transfer member;

a secondary transfer unit configured to transfer the toner image formed on the intermediate transfer member onto a recording material;

a tension member configured to support the intermediate transfer member; and a control unit configured to perform control so that, when the secondary transfer unit transfers the toner image onto a recording material, the leading edge and the trailing edge of the recording material overlap an imprint portion formed in the intermediate transfer member by the tension member.

9. An image forming apparatus comprising:

an image bearing member;

a developing unit configured to develop a latent image formed on the image bearing member into a toner image;

an intermediate transfer member;

a transfer unit configured to transfer the toner image formed on the image bearing member onto the intermediate transfer member;

a tension member configured to support the intermediate transfer member;

a receiving unit configured to receive image information used for forming the toner image; and a control unit configured to control a point in time at which the transfer unit transfers the toner image based on the received image information so that only the leading edge, only the trailing edge, or the leading edge and the trailing edge of the toner image are transferred onto an imprint portion formed in the intermediate transfer member by the tension member.

10. The image forming apparatus according to claim 9, wherein the control unit controls a position at which the intermediate transfer member stops so that the imprint portion is formed within a predetermined range of the intermediate transfer member.

11. The image forming apparatus according to claim 10, wherein the control unit controls a position at which the intermediate transfer member stops so that a plurality of the imprint portion are formed within a predetermined range of the intermediate transfer member.

12. The image forming apparatus according to claim 9, wherein the control unit controls a ratio of the leading edge to the trailing edge of the toner image to be transferred based on the received image information when the leading edge and the trailing edge of the toner image are transferred onto the imprint portion formed in the intermediate transfer member by the tension member.

13. The image forming apparatus according to claim 9, wherein the imprint portion is formed by a tension member with a smallest diameter.

14. An image forming apparatus comprising:

an image bearing member;

a developing unit configured to develop a latent image formed on the image bearing member into a toner image;

an intermediate transfer member;

a primary transfer unit configured to transfer the toner image formed on the image bearing member onto the intermediate transfer member;

a secondary transfer unit configured to transfer the toner image formed on the intermediate transfer member onto a recording material;

a tension member configured to support the intermediate transfer member;

a receiving unit configured to receive image information used for forming the toner image; and a control unit configured to perform control based on the received image information so that, when the secondary transfer unit transfers the toner image onto a recording material, only the leading edge, only the trailing edge, or the leading edge and the trailing edge of the recording material overlap an imprint portion formed in the intermediate transfer member by the tension member.

15. The image forming apparatus according to claim 5, wherein the control unit controls the position at which the intermediate transfer member stops so that the tension member forms an imprint portion in an area of the intermediate transfer member in which the toner image is not intended to be transferred, and wherein a plurality of the stop positions are set in the area of the intermediate transfer member in which the toner image is not intended to be transferred.

* * * * *